US008355659B2

(12) United States Patent
Kagawa et al.

(10) Patent No.: US 8,355,659 B2
(45) Date of Patent: Jan. 15, 2013

(54) FIXING DEVICE AND IMAGE FORMING APPARATUS HAVING SAME

(75) Inventors: Toshiaki Kagawa, Osaka (JP); Susumu Murakami, Osaka (JP); Masashi Hirai, Osaka (JP); Atsushi Ide, Osaka (JP); Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 420 days.

(21) Appl. No.: 12/686,463

(22) Filed: Jan. 13, 2010

(65) Prior Publication Data

US 2010/0183345 A1 Jul. 22, 2010

(30) Foreign Application Priority Data

Jan. 21, 2009 (JP) ..... 2009-010959

(51) Int. Cl.
*G03G 15/20* (2006.01)

(52) U.S. Cl. ..... 399/325; 399/326; 399/327

(58) Field of Classification Search ..... 399/325, 399/326, 327
See application file for complete search history.

(56) References Cited

U.S. PATENT DOCUMENTS

| | | | | |
|---|---|---|---|---|
| 5,546,174 | A * | 8/1996 | Hashizume et al. | 399/327 |
| 5,937,255 | A | 8/1999 | Kagawa | |
| 6,219,520 | B1 * | 4/2001 | Ehara | 399/325 |
| 6,351,619 | B1 * | 2/2002 | Yamada | 399/70 |
| 6,579,813 | B1 * | 6/2003 | Kimura et al. | 442/320 |
| 2003/0095806 | A1 * | 5/2003 | Wu et al. | 399/45 |
| 2007/0189817 | A1 | 8/2007 | Kagawa | |
| 2008/0124144 | A1 * | 5/2008 | Mukai et al. | 399/327 |

FOREIGN PATENT DOCUMENTS

| | | | |
|---|---|---|---|
| JP | 53-010437 | A | 1/1978 |
| JP | 53-089445 | A | 8/1978 |
| JP | 56-036674 | A | 4/1981 |
| JP | 57-076580 | A | 5/1982 |
| JP | 10-282827 | A | 10/1998 |
| JP | 2002-365958 | A | 12/2002 |
| JP | 2003-215971 | A | 7/2003 |
| JP | 2005-099070 | A | 4/2005 |
| JP | 311165 | U | 7/2005 |
| JP | 2007-212896 | A | 8/2007 |

* cited by examiner

*Primary Examiner* — David Gray
*Assistant Examiner* — Andrew Do
(74) *Attorney, Agent, or Firm* — Renner, Otto, Boisselle & Sklar, LLP

(57) ABSTRACT

A fixing device of the present invention includes: an external heating belt which is to contact with a surface of a fixing roller so as to heat up the fixing roller; and a cleaning member (a scraper and/or cleaning pad) which is to contact with the external heating belt. The cleaning pad which is impregnated with silicone oil is to contact with a surface of the external heating belt, thereby applying the silicone oil (release agent) to the surface of the external heating belt. This makes it possible to prevent generation of an offset.

4 Claims, 4 Drawing Sheets

FIXING DEVICE AND IMAGE FORMING APPARATUS HAVING SAME

This Nonprovisional application claims priority under 35 U.S.C. §119(a) on Patent Application No. 2009-010959 filed in Japan on Jan. 21, 2009, the entire contents of which are hereby incorporated by reference.

TECHNICAL FIELD

The present invention relates to a fixing device to be provided in an image forming apparatus of an electrophotographic printing method, and to an image forming apparatus having the fixing device

BACKGROUND ART

A fixing device of a heat roller fixing method is widely used as a fixing device to be provided in an image forming apparatus of an electrophotographic printing method such as a copying machine or a printer. In general, a fixing device of a heat roller fixing method includes a pair of rollers (fixing roller and pressure roller) which are pressed against each other. The pair of rollers is heated to a predetermined temperature (fixing temperature) by heating means which is made up of a halogen heater etc. provided inside each or either one of the pair of rollers. Then, a sheet of recording paper on which an unfixed toner image is formed is fed to a pressure area (fixing nip area) of the pair of rollers so that the sheet of recording paper is passed through the pressure area. Thus, the toner image is fixed onto the sheet of recording paper by application of heat and pressure.

In a fixing device to be provided in a color image forming apparatus, in general, an elastic roller is adopted as the fixing roller. The elastic roller has, as its surface layer, an elastic layer made of silicone rubber or the like. By adopting the elastic roller as the fixing roller, the surface of the fixing roller undergoes elastic deformation in accordance with asperities of an unfixed toner image. Accordingly, the surface of the fixing roller makes contact with the unfixed toner image so as to wrap the unfixed toner image. This makes it possible to properly fix, onto a sheet of recording paper, an unfixed color toner image which is larger in its toner amount than that of a monochrome one. In addition, an effect of releasing deformation of the elastic layer in the fixing nip area allows the fixing roller to have improved releasability to color toner which is more likely to undergo offset than a monochrome one. Furthermore, the elastic layer of the fixing roller deforms so as to have a concave shape. Accordingly, the fixing nip area has a nip shape which is convex upward (i.e., convex toward the fixing roller; a so-called inverse nip shape). This makes it possible to improve an ability of the fixing roller to peel a sheet of recording paper from the fixing roller. Accordingly, the sheet of recording paper can be peeled from the fixing roller, without the use of peeling means such as a peeling claw (self-stripping). This makes it possible to eliminate a defect of an image caused by the peeling means.

However, in some cases, the fixing device to be provided in the color image forming apparatus cannot properly fix an unfixed toner image onto a sheet of recording paper at a high processing speed (passing speed of the sheet of recording paper in the fixing nip area; fixing speed) because sufficient heat cannot be applied to the unfixed toner image. Therefore, it is necessary to widen a nip width of the fixing nip area in order to properly perform a fixing process at a high processing speed by applying sufficient heat to the unfixed toner image. Possible methods for widening the nip width are (1) increasing a thickness of the elastic layer of the fixing roller and (2) increasing a diameter of the fixing roller.

However, the elastic layer has an extremely low heat conductivity. Therefore, an arrangement in which, as is the case with a conventional one, the fixing roller has the elastic layer and contains the heating means has a problem in that a surface temperature becomes less likely to follow a temperature change of the heating means in a case where the processing speed is increased. Accordingly, the problem of the weakening follow-up behavior of the surface temperature of the fixing roller becomes prominent in a case where the elastic layer is thicken by the method of (1) above. Furthermore, the method of (1) has a problem of a longer warm-up time for heating and a problem of increased power consumption, because of the low heat conductivity of the elastic layer.

On the other hand, in a case where the diameter of the fixing roller is increased by the method of (2) above, there arise a problem of a longer warm-up time for heating and a problem of increased power consumption, because the fixing roller has a large heat capacity due to its increased size.

As a solution to the problems, an art (external heating and fixing method) is proposed in which external heating means is pressed against the surface of the fixing roller so that the fixing roller is externally heated.

For example, Patent Literature 1 discloses a fixing device of an external belt heating and fixing method. The fixing device includes: a fixing member; an endless belt (external heating belt) suspended by a plurality of suspension rollers; and heating means for heating the endless belt. The fixing device heats the fixing member by pressing the endless belt against the fixing member.

The fixing device which adopts the external belt heating and fixing method externally heats the fixing roller by use of a belt having a small heat capacity. This makes it possible to heat the fixing roller swiftly, and thereby reduce a warm-up time. Therefore, it is possible to secure a wide nip width by providing a thick elastic layer having a low hardness to the fixing roller, and/or increasing a diameter of the fixing roller, while preventing problems such as the weakening follow-up behavior of the surface temperature of the fixing roller and the increase in warm-up time.

Patent Literature 1

Japanese Patent Application Publication, Tokukai, 2007-212896 A (Publication Date: Aug. 23, 2007)

SUMMARY OF INVENTION

However, according to the art disclosed in Patent Literature 1, a cleaning web is to contact with a fixing roller at an upstream, in a rotation direction of the fixing roller, of an abutting position of the fixing roller where the fixing roller is to contact with the external heating belt. By the arrangement, toner, paper powder, etc. adhered onto the surface of the fixing roller are removed, thereby preventing the toner, paper powder, etc. from contaminating the external heating belt. This arrangement has a problem in that the fixing roller is damaged by rubbing between the cleaning web and the surface of the fixing roller, thereby causing an image defect.

As a solution to this, there is the following possible prevention. The cleaning web which rubs the fixing roller is not provided but a cleaning member such as a scraper or a pad is provided so as to have contact with the external heating belt, thereby preventing toner, paper powder, etc. from contaminating the external heating belt and the fixing roller (The arrangement is not a conventional art but is invented by the inventors of the present invention).

However, as a result of study on the arrangement, the inventors of the present invention have found that, the contact between the external heating belt and the cleaning member such as a scraper or a pad scrapes off a coating material (covering layer) of the external heating belt, and the coating material which has been scraped off adheres to the fixing roller, thereby decreasing releasability of the fixing roller.

In particular, it has been found that, in a fixing process of a large-size sheet of paper performed immediately after sequential fixing processes of small-size sheets of paper, due to a decrease in releasability of the fixing roller, hot offset is likely to occur in an area on the fixing roller which area has no contact with the small-size sheets of paper. The reason for this is considered as below.

That is, in the case of a fixing process of a large-size sheet of paper, the coating material adhered onto the fixing roller further adheres onto the large-size sheet of paper. Accordingly, the surface of the fixing roller is always cleaned by large-size sheets of paper. This maintains the releasability of the fixing roller. However, in the case of sequential fixing processes of small-size sheets of paper, the coating material is accumulated in a non-passage area (i.e., an area on the surface of the fixing roller which area does not have contact with the small-size sheets of paper), thereby making the releasability of the non-passage area lower than that of a passage-area (i.e., an area on the surface of the fixing roller which area has contact with the small-size sheets of paper). In addition, in the case of the sequential processes of the small-sized sheets of paper, the non-passage area has a temperature which is higher than that of the passage area. As a result, hot offset is likely to occur. Furthermore, upon passage of a negatively-charged (approximately −500V) sheet of paper, the passage area has a negative potential which is higher than that of the non-passage area. Accordingly, the passage area has a large electrostatic repulsion against negatively-charged toner. As a result, the passage area is unlikely to electrostatically cause offset. In contrast, the non-passage area has a negative potential which is lower than that of the passage area because the negatively-charged sheet of paper is not passed through the non-passage area. Accordingly, the non-passage area is likely to cause offset. Therefore, in the fixing process of a large-size sheet of paper performed immediately after the sequential fixing processes of the small-size sheets of paper, hot offset is likely to occur in the non-passage area.

The present invention is made in view of the problems. An object of the present invention is to suppress an occurrence of the offset in a fixing device of an external heating method which fixing device includes: an external heating member for having contact with the surface of a fixing member so as to heat the fixing member; and a cleaning member for having contact with the surface of the external heating member so as to clean the surface.

In order to attain the object, a fixing device of the present invention includes: a fixing member which is capable of rotating; a pressure member which pressures the fixing member; an external heating member which is to contact with a surface of the fixing member so as to heat up the fixing member, the external heating member being rotatably suspended; a cleaning member which is to contact with the surface of the external heating member so as to remove a contaminant adhered to the surface of the external heating member; and a release agent applying means which applies a release agent for improving releasability to (i) the surface of the external heating member which surface is to contact with the cleaning member and the fixing member or (ii) the surface of the fixing member which surface is to contact with the external heating member, a recording material being carried to a section between the fixing member and the pressure member and then a toner image on the recording material being thermally fixed to the recording member by heat conducted from the fixing member.

According to the configuration, by the release agent applying means, a release agent for improving releasability is applied to (i) the surface of the external heating member which surface is to contact with the cleaning member and the fixing member or (ii) the surface of the fixing member which surface is to contact with the external heating member. The release agent serves to prevent a surface material of the external heating member from being scraped by the cleaning member. Moreover, (i) the release agent, which has been applied on the surface of the external heating member and then transferred to the surface of the fixing member, or (ii) the release agent applied to the surface of the fixing member improves releasability of the surface of the fixing member. Accordingly, a substance, etc. scraped from the external heating member by the cleaning member and a toner hardly adhere to the surface of the fixing member. This makes it possible to prevent an offset from being generated.

Advantageous Effects of Invention

As described above, a fixing device of the present invention includes a release agent applying means for applying a release agent for improving releasability of (i) the surface of the external heating member which surface is to contact with the cleaning member and the fixing member or (ii) the surface of the fixing member which surface is to contact with the external heating member.

The above described configuration of the present invention makes it possible to prevent an offset from being generated.

REFERENCE SIGNS LIST

1: Fixing roller (fuser roller, fixing member)
2: Pressure roller (pressure member)
3: External heating belt (external heating member, endless belt)
4*a* and 4*b*: Heat rollers (suspension rollers)
5*a* through 5*d*: Heater lamp (heating section)
6*a* through 6*c*: Thermistors
7: Scraper (cleaning member)
7*a*: Cleaning section
7*b*: Holding section
7*c*: Slit
9: Sheet of recording paper (recording material)
11: External heating unit holder

12: Cleaning pad (cleaning member, release agent applying means)
12*a*: Felt member (cleaning member, release agent applying means)
12*b*: Felt holding member
13: External heating unit
19: Oil applying roller (release agent applying means)
19*a*: Cored bar
19*b*: Oil holding layer
19*c*: Oil controlling layer (release agent applying means)
30: Fixing device
100: Image forming apparatus

DESCRIPTION OF EMBODIMENTS

1-1. Arrangement of Image Forming Apparatus

The following describes one embodiment of the present invention. The present embodiment describes application of the present invention to a color-tandem type image forming apparatus which forms a multicolor or monochrome image on a recording material in accordance with image data. However, the present invention is applicable not only to this. That is, the present invention is applicable to any image forming apparatus, provided that the image forming apparatus has a fixing device of an external heating method which fixing device has: an external heating member for having contact with the surface of a fixing member so as to heat the fixing member; and a cleaning member for having contact with the surface of the external heating member so as to clean the surface of the external heating member.

Figure 2:
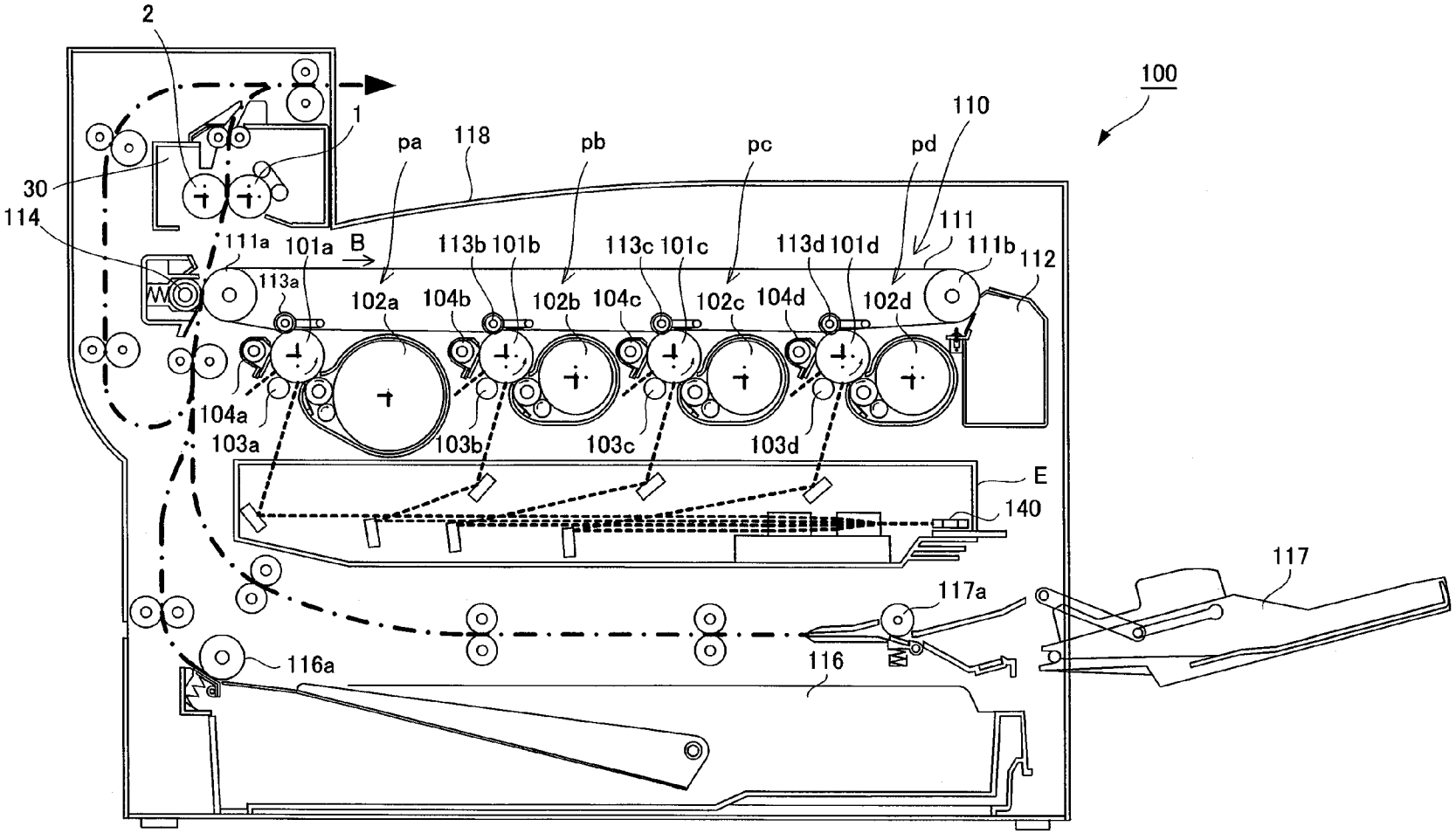
FIG. 2 is a cross-sectional view illustrating an image forming apparatus having the fixing device illustrated in FIG. 1.

FIG. 2 is a cross-sectional view illustrating a schematic arrangement of an image forming apparatus 100 of the present embodiment. As illustrated in FIG. 2, the image forming apparatus 100 includes an exposure unit (optical-system unit) E; four visible image forming units pa through pd; an intermediate transfer belt unit 110; a second transfer unit 114; a fixing device 30; an internal paper feeding unit 116; and a manual paper feeding unit 117. Respective operations of the members provided in the image forming apparatus 100 are controlled by a main control section having a CPU etc. (not illustrated).

Image data to be dealt by the image forming apparatus 100 corresponds to a color image in which the following four colors are used: black (K), cyan (C), magenta (M), and yellow (Y). Accordingly, as illustrated in FIG. 2, the four visible image forming units pa through pd are provided so as to correspond respectively to the four colors. That is, the four visible image forming units pa through pd form respective four toner images in respective colors. Then, the four toner images are superimposed on the intermediate transfer belt 111.

The visible image forming unit pa is configured such that a charging unit 103*a*, a developing unit 102*a*, and a cleaning unit 104*a* are provided in this order, along a rotation direction of a photoreceptor 101*a*, around the photoreceptor 101*a* which is a toner image bearing member and is rotatably provided.

The charging unit 103*a* is a member for uniformly charging the surface of the photoreceptor 101*a* to a predetermined electric potential. In the present embodiment, a roller charging method (contact charging method) is adopted as a charging method of the charging unit 103*a*, in order that the surface of the photoreceptor 101*a* is uniformly charged with less generation of ozone. However, an arrangement of the charging unit 103*a* is not limited to this. For example, it is possible to adopt a noncontact-type charger such as that of a corona charging method. Alternatively, it is possible to adopt a contact-type charger such as that of a brush charging method.

The developing unit 102*a* performs a development process in which an electrostatic latent image formed on the photoreceptor 101*a* is made visible by toner. The toner can be, for example, a nonmagnetic single-component developer (nonmagnetic toner), a nonmagnetic two-component developer (nonmagnetic toner and a carrier), a magnetic developer (magnetic toner), or the like.

The cleaning unit 104*a* is a member for removing and collecting toner which remains on the surface of the photoreceptor 101*a* after a toner image is transferred onto the intermediate transfer belt 111.

The visible image forming units pb through pd are arranged substantially the same as the visible image forming unit pa except that toner colors used in the development process are different from that of the visible image forming unit pa. That is, respective developing units 102*a* through 102*d* of the visible image forming units pa through pd store black (K) toner, yellow (Y) toner, magenta (M) toner, and cyan (C) toner, respectively.

In accordance with image data, the exposure unit E exposes the photoreceptors 101*a* through 101*d* which have been charged by the charging units 103*a* through 103*d*, thereby forming electrostatic latent images respectively on the surfaces of the photoreceptors 101*a* through 101*d* in accordance with the image data. The exposure unit E is a laser scanning unit (LSU) which includes a laser irradiation section 140, a reflection mirror 141, etc. The exposure unit E can be, for example, an EL or LED writing head in which light-emitting elements are arranged in an array.

The intermediate belt unit 110 includes the intermediate transfer belt 111, an intermediate transfer belt driving roller (tension roller) 111*a*, an intermediate transfer belt driven roller (tension roller) 111*b*, an intermediate transfer belt cleaning unit 112, and intermediate transfer rollers 113*a* through 113*d*.

The intermediate transfer belt 111 is an endless belt made of a film having a thickness ranging from approximately 100 μm to approximately 150 μm. The intermediate transfer belt 111 is provided in a tensioned state among the intermediate transfer rollers 113*a* through 113*d*, the intermediate transfer belt driving roller 111*a*, and the intermediate transfer belt driven roller 111*b*. The intermediate transfer belt 111 is driven to rotate in a direction indicated by an arrow B in FIG. 2. The four toner images of respective colors formed on the photoreceptors 101*a* through 101*d* are transferred onto the intermediate transfer belt 111 so as to be sequentially superimposed, thereby forming a color toner image (multicolor toner image) on the intermediate transfer belt 111. The intermediate transfer roller 113*a* is provided so as to face the photoreceptor 101*a* via the intermediate transfer belt 111 between a position where the photoreceptor 101*a* faces the developing unit 102*a* and a position where the photoreceptor 101*a* faces the cleaning unit 104*a*. The intermediate transfer rollers 113*b* through 113*d* are provided in the same manner. A high voltage having a polarity (+) which is opposite to a polarity (−) of toner is applied to the intermediate transfer rollers 111*a* through 113*d*, and thereby respective toner images formed on the photoreceptors 101*a* through 101*d* are transferred onto the intermediate transfer belt 111. The toner image formed on the intermediate transfer belt 111 is carried to a position at which the intermediate transfer belt driving roller 111*a* faces the second transfer unit 114, and thereby the toner image is transferred onto a sheet of recording paper carried to the position. The intermediate transfer belt cleaning unit 112 has contact with the intermediate transfer belt 111.

The intermediate transfer belt cleaning unit 112 removes and collects toner which remains on the intermediate transfer belt 111 after the toner image is transferred onto the sheet of recording paper.

The fixing device 30 includes a fixing roller (fixing member) 1 and a pressure roller (pressure member) 2 which is pressed against the fixing roller 1 at a predetermined load applied by auxiliary pressure means (not illustrated). The fixing device 30 feeds the sheet of recording paper on which the toner image has been transferred by the second transfer unit 114, to a pressure area (fixing nip area) between the fixing roller 1 and the pressure roller 2. The fixing device 30 passes the sheet of recording paper through the pressure area so that a heat and a pressure are applied to the toner image, thereby fixing the toner image onto the sheet of recording paper. One side of a sheet of recording paper on which an unfixed toner image is formed makes contact with the fixing roller 1 while the other side makes contact with the pressure roller 2. Details of the fixing device 30 are described later.

The internal paper feeding unit 116 is a member for storing sheets of recording paper (recording material) to be used in image formation. The manual paper feeding unit 117 is a member for manually feeding a sheet of recording paper. The manual paper feeding unit 117 is foldably provided onto a sidewall of the image forming apparatus 100. A paper output tray 118 is a tray for placing a printed sheet of recording paper thereon.

The image forming apparatus 100 includes a paper carrying path for carrying: (i) a sheet of recording paper fed from the internal paper feeding unit 116 by a pickup roller 116*a*; and (ii) a sheet of recording paper fed from the manual paper feeding unit 117 by a pickup roller 117*a*, to the paper output tray 118 via the second transfer unit 114 and the fixing device 30. Many roller members for carrying a sheet of recording paper are provided along the paper carrying path.

The image forming apparatus 100 of the present embodiment is a so-called A4 device supporting paper sizes up to an A4 size (297 mm×210 mm; JIS (Japanese Industrial Standards)-P0138) and a letter size (279.4 mm×215.9 mm (11 inches×8.5 inches). Therefore, the image forming apparatus 100 also supports an A5 size (210 mm×148 mm) and an invoice size (215.9 mm×139.7 mm (8.5 inches×5.5 inches)) which are smaller than the A4 size and the letter size.

1-2. Fixing Device

Figure 1:
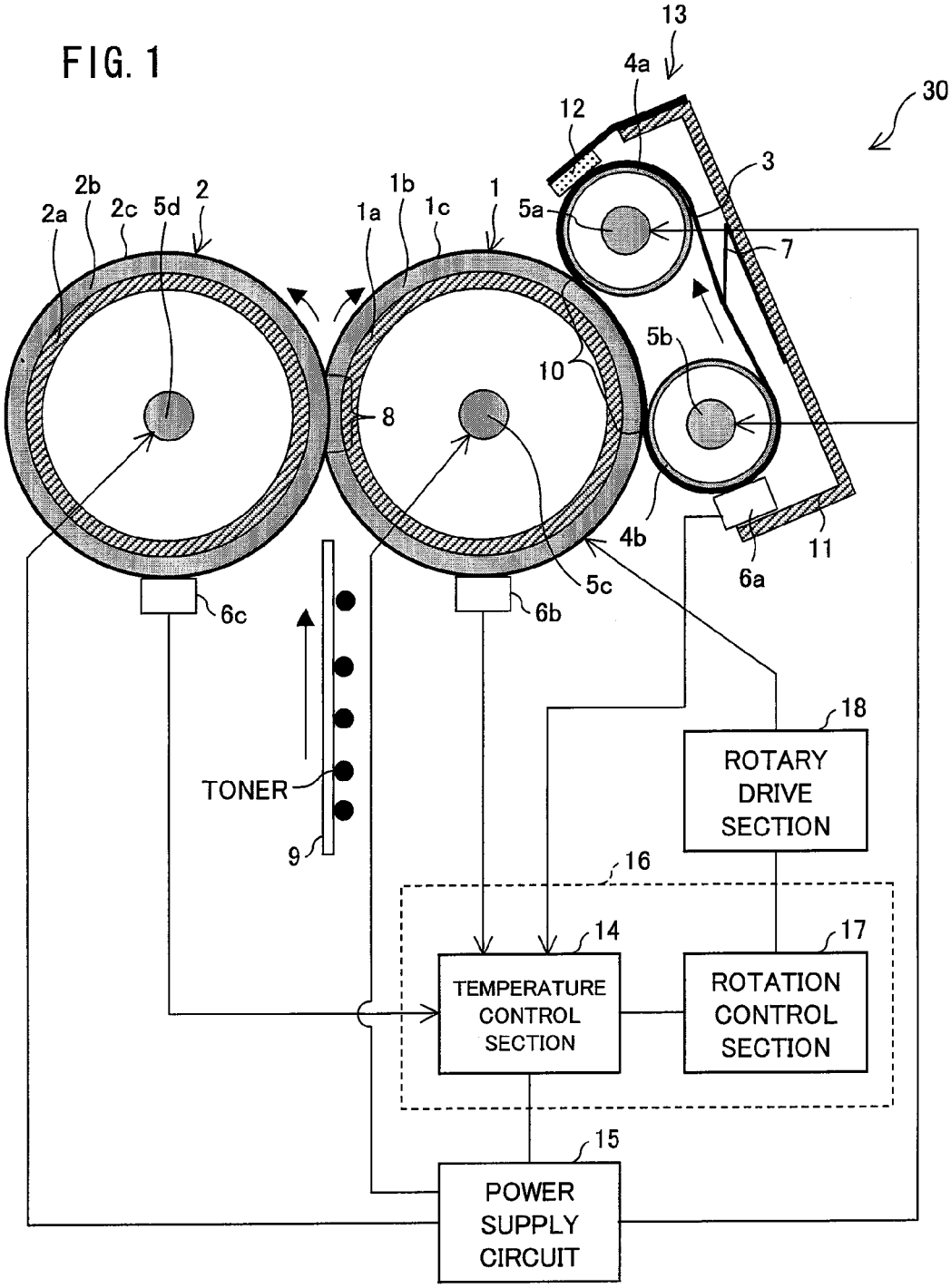
FIG. 1 is an explanatory view illustrating an arrangement of a fixing device of one embodiment of the present invention.

FIG. 1 is a schematic cross-sectional view illustrating an arrangement of the fixing device 30. As illustrated in FIG. 1, the fixing device 30 includes the fixing roller (fixing member) 1, the pressure roller (pressure member) 2, an external heating unit 13, a power supply circuit 15, a control section 16, and a rotary drive section 18. The power supply circuit 15 is a member for supplying power to heater lamps 5*a* through 5*d*.

The fixing roller 1 is a roller which is heated to a predetermined fixing temperature and is driven by the rotary drive section 18 to rotate in a direction indicated by an arrow in FIG. 1. The fixing roller 1 has a three-layered structure made up of: a hollow cylindrical metal cored bar 1*a*, an elastic layer 1*b* covering an outer surface of the cored bar 1*a*, and a release layer (surface layer) 1*c* covering the elastic layer 1*b*. The rotary drive section 18 is a member for rotating the fixing roller 1, and is made up of a motor, a gear, etc. (not illustrated). In the present embodiment, a moving speed of the surface of the fixing roller 1, i.e., a fixing speed (processing speed) is set to 225 mm/sec. This allows image formation at a copying speed (printing speed) of 40 sheets per minute.

In the present embodiment, a fixing roller 1, which has an external diameter of 40 mm, is used. The fixing roller 1 includes: a cored bar 1*a* having a cylindrical shape made of aluminum having a thickness of 2 mm; an elastic layer 1*b* made of heat-resistant silicone rubber having a thickness of 2.5 mm and covering an external face of the cored bar 1*a*; and a nonconductive PFA (a copolymer of tetrafluoroethylene and perfluoroalkylvinylether) tube having a thickness of 40 μm and covering the elastic layer 1*b*. A material of the cored bar 1*a* is not limited to aluminum. For example, the cored bar 1*a* can be made of iron, stainless steel, or the like. A material of the elastic layer 1*b* is not limited to silicone rubber. For example, the material can be fluororubber or the like. A material of the release layer 1*c* can be anything, provided that the material excels in heat resistance, durability, and releasability to toner. Except for PFA, it is possible to adopt a fluorine-containing material such as PTFE (polytetrafluoroethylene). Note however that, in the present embodiment, the releasing layer 1*c* of the fixing roller 1 is made of a material having releasability higher than that of a releasing layer 2*c* of the pressure roller 2.

A thermistor (temperature sensing section) 6*b* for detecting a temperature of the outer surface of the fixing roller 1 is provided on the outer surface. The fixing roller 1 houses a heater lamp 5*c* therein. The heater lamp 5*c* receives power supply so as to perform heat radiation. The heater lamp 5*c* is a heat source of the fixing roller 1. A temperature control section 14 provided in the control section 16 controls power supplied from the power supply circuit 15 to the heater lamp 5*c*. Under the control, the heater lamp 5*c* emits light, thereby radiating infrared rays. Accordingly, an inner surface of the fixing roller 1 is heated by absorbing the infrared rays radiated from the heater lamp 5*c*. As a result, the fixing roller 1 is heated entirely. The thermistor 6*b* is provided so as to detect a temperature of an area on the fixing roller 1 which area lies in the center with respect to a direction of a rotation axis of the fixing roller 1 (i.e., with respect to a width direction). In the present embodiment, regardless of a size of a sheet of recording paper, an area of a sheet of recording paper which area lies substantially in the center with respect to a direction perpendicular to a carrying direction of the sheet of recording paper makes contact with the area of the fixing roller 1 which area lies in the center with respect to the direction of the rotation axis of the fixing roller 1. Accordingly, regardless of a paper size, the thermistor 6*b* always detects a temperature of a position in an area on the surface of the fixing roller 1 through which area a sheet of recording paper is passed. In the present embodiment, the fixing temperature is referred to as a temperature detected by the thermistor 6*b* in a fixing process.

The pressure roller 2 is a roller which is (i) pressed against the fixing roller 1 at the predetermined load (360N in the present embodiment) applied by the auxiliary pressure means (not illustrated) such as a spring, thereby forming a fixing nip area 8 (fixing nip width (i.e., width of a sheet of recording paper 9 in the fixing nip area 8 along the carrying direction of the sheet of recording paper 9) of 8 mm in the present embodiment) between the pressure roller 2 and the fixing roller 1, and (ii) driven by the fixing roller 1 to rotate. As is the case with the fixing roller 1, the pressure roller 2 has a three-layered structure made up of: a hollow cylindrical metal cored bar 2*a*, an elastic layer 2*b* covering an outer surface of the cored bar 2*a*, and a release layer (surface layer) 2*c* covering the elastic layer 2*b*.

In the present embodiment, as is the case with the fixing roller 1, the pressure roller 2 of the present embodiment is made as below. The elastic layer 2*b* made of a 2.5 mm thick silicone rubber is formed on the cored bar 2*a* made of a 2 mm thick aluminum plate. The release layer 2*c* made of a 40 μm thick nonconductive PFA tube is further formed on the elastic layer 2*b*. An arrangement of the pressure roller 2 is not limited to this. For example, it is possible to use: a cored bar 2*a* made of iron, stainless steel, or the like; an elastic layer 2*b* made of fluororubber or the like; and a release layer 2*c* made of a fluorine-containing material such as PTFE. In the present embodiment, the pressure roller 2 is a roller of the same shape and the same materials as those of the fixing roller 1. However, an arrangement of the pressure roller 2 is not limited to this. For example, a hardness of the pressure roller 2 can be set higher than that of the fixing roller 1. In this case, it is possible to give an inverse nip shape (i.e. A shape of the pressure roller 2 is hardly changed while the fixing roller 1 is slightly dented) to the fixing nip area to be formed between the pressure roller 2 and the fixing roller 1. This allows a sheet of recording paper to have an improved self-detachability to the fixing roller 1 in a discharge of the sheet of recording paper from the fixing nip area.

A thermistor 6*c* for detecting a temperature of an outer surface of the pressure roller 2 is provided on the outer surface. The pressure roller 2 houses the heater lamp 5*d* therein. As is the case with the thermistor 6*b* of the fixing roller 1, the thermistor 6*c* is provided in an area of the pressure roller 2 which area lies in the center with respect to a direction of a rotation axis of the pressure roller 2 (i.e., with respect to a width direction). The heater lamp 5*d* is a heat source of the pressure roller 2. The temperature control section 14 controls power supplied from the power supply circuit 15 to the heater lamp 5*d*. Under the control, the heater lamp 5*d* radiates infrared rays, thereby heating the internal surface of the pressure roller 2.

The external heating unit 13 is a member for heating the outer surface of the fixing roller 1. The external heating unit 13 includes: heat rollers 4*a* and 4*b*, an external heating belt (endless belt) 3, the heater lamps (heating sections) 5*a* and 5*b*, a thermistor 6*a*, a scraper (cleaning member) 7, a cleaning pad (cleaning member, a release agent applying means) 12, and an external heating unit holder (housing) 11 for containing the members above.

Each of the heat rollers 4*a* and 4*b* is a hollow cylindrical cored bar which has a diameter of 16 mm and is made of an aluminum plate having a thickness of 2 mm. A material of the heat rollers 4*a* and 4*b* is not limited to aluminum. Alternatively, it is possible to use a metal cored bar made of, e.g., iron, stainless steel, or the like. Respective sizes of the heat rollers 4*a* and 4*b* are not limited to the above but can be suitably altered.

The external heating belt 3 is an endless belt member suspended between the heat rollers 4*a* and 4*b*. The present embodiment adopted an endless belt made of a belt substrate of polyimide (resin material). When forming a circle, the belt substrate has a diameter of 31.5 mm and a thickness of 90 μm. Note that an external face of the external heating belt 3 is covered with a coating layer, for improving releasability, made of a nonconductive PTFE coat (coating material) having a thickness of 20 μm. However, the configuration of the external heating belt 3 is not limited to this. For example, the coating material may be a conductive coating material containing such as carbon. For example, instead of the belt substrate made of polyimide, it is possible to adopt a hollow cylindrical (endless) belt substrate made of another heat-resistant resin or a metal material such as stainless steel or nickel. In addition, it is possible to coat, with PTFE etc, the inner surface of the belt substrate, in order to reduce a deviation force that acts on the external heating belt 3 (i.e., force that acts on the external heating belt 3 so as to move the external heating belt 3 in a direction of a rotation axis of the external heating belt 3).

At a position on the fixing roller 1 which position is situated (i) at a downstream of the fixing nip area on the surface (external face) of the fixing roller 1 in the rotation direction of the fixing roller 1, and (ii) at an upstream of the thermistor 6*b* in the rotation direction of the fixing roller 1, the external heating belt 3 is provided so as to be pressed against the fixing roller 1 at a predetermined load (40N in the present embodiment) applied by auxiliary pressure means (not illustrated) such as a spring. Accordingly, a heating nip area 10 (i.e., area in which the fixing roller 1 and the external heating belt 3 have contact with each other) is formed between the external heating belt 3 and the fixing roller 1. The external heating belt 3 is driven by the fixing roller 1 to rotate when the fixing roller 1 rotates. The heat rollers 4*a* and 4*b* are driven by the external heating belt 3 to rotate. A heating nip width of the heating nip area 10 (width of the heating nip area 10 along the rotation direction of the fixing roller 1) is set so that the external heating belt 3 can properly heat the fixing roller 1 and can be properly driven by the fixing roller 1 to rotate. In the present embodiment, the heating nip width is set to 20 mm.

The heater lamp 5*a* is a heat source which is provided inside the heat roller 4*a* and which heats the heat roller 4*a* from the inner surface side thereof. The heater lamp 5*b* is a heat source which is provided inside the heat roller 4*b* and which heats the heat roller 4*b* from the inner surface side thereof. The temperature control section 14 controls power supplied from the power supply circuit 15 to the heater lamps 5*a* and 5*b*. Under the control, the heater lamps 5*a* and 5*b* radiate infrared rays, thereby heating respective inner surfaces of the heat rollers 4*a* and 4*b*. Accordingly, the external heating belt 3 is heated to a predetermined temperature via the heat rollers 4*a* and 4*b*. By contact between the external heating belt 3 heated to the predetermined temperature and the outer surface of the fixing roller 1, the outer surface of the fixing roller 1 is externally heated. In a case where the fixing temperature is 190° C. for example, the external heating belt 3 is heated to 220° C.

The thermistor 6*a* is a member for measuring a surface temperature of the external heating belt 3. The thermistor 6*a* is provided so as to measure a temperature of an area of the external heating belt 3 which area lies in the center with respect to the direction of the rotation axis of the external heating belt 3 (i.e., with respect to a width direction).

The scraper 7 is a member for cleaning the outer surface of the external heating belt 3 by removing contaminants such as toner and paper powder which is transferred from the fixing roller 1 to the external heating belt 3. The cleaning pad 12 is a member for collecting toner, paper powder, etc. remaining on the external heating belt 3 which have passed through the scraper 7.

That is, as illustrated in FIG. 1, the fixing roller 1 makes contact with a side of the sheet of recording paper 9 on which an unfixed toner image is formed, in order to fix the unfixed toner on the side. Accordingly, contaminants such as toner and paper powder on the sheet of recording paper 9 adheres to the fixing roller 1. The contaminants adhered to the fixing roller 1 further adheres to the external heating belt 3 at an abutting section between the fixing roller 1 and the external heating belt 3. The scraper 7 is a member for removing the contaminants adhered to the external heating belt 3 by scraping off the contaminants.

Figure 3:
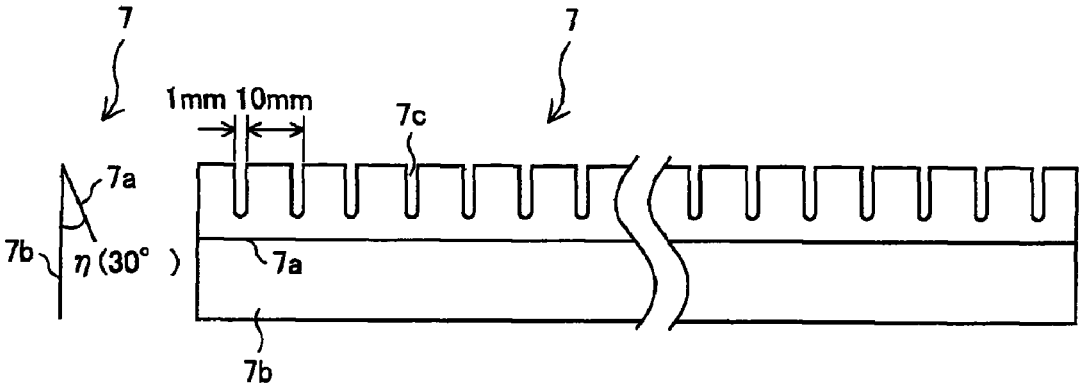
FIG. 3 is an elevation view and side view illustrating a scraper provided in the fixing device illustrated in FIG. 1.

FIG. 3 is an elevation view and side view of the scraper 7. The scraper 7 has a shape like a letter "V" which shape is formed by a holding section 7*b* made of a 0.3 mm thick stainless steel plate, and a cleaning section (scraper section) 7*a* which is formed by folding an end of the holding section 7*b* at a sharp angle (angle η; η=30° in the present embodiment). In addition, as illustrated in FIG. 3, slits (openings; slots formed in a direction intersecting with a straight line along which the holding section 7*b* is folded) 7*c* are provided to a folded part between the holding section 7*b* and the cleaning section 7*a*, at predetermined intervals in a width direction of the external heating belt 3. In the present embodiment, the slits 7*c* each having a width of 1 mm are formed, at intervals of 10 mm, by cutting into the folded part in a direction substantially perpendicular to the straight line along which the holding section 7*b* is folded.

Figure 4:
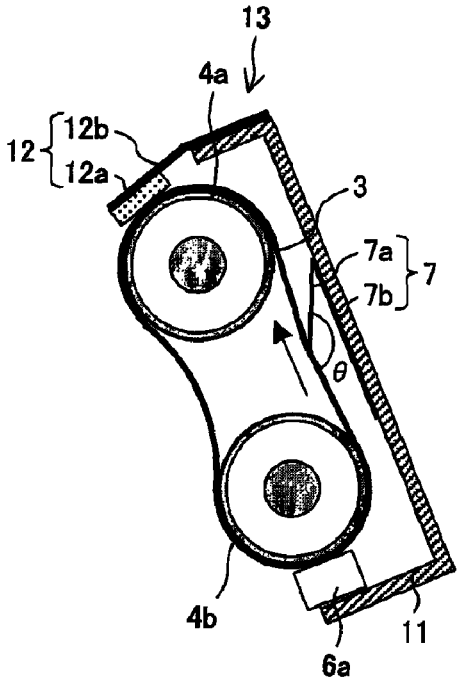
FIG. 4 is a cross-sectional view illustrating an external heating unit provided in the fixing device illustrated in FIG. 1.

FIG. 4 is a cross-sectional view of the external heating unit 13. As illustrated in FIG. 4, the holding section 7*b* of the scraper 7 is fixed to an internal surface of an external heating unit holder 11 so that an edge of the cleaning section 7*a* of the scraper 7 has contact with the external heating belt 3. The edge of the cleaning section 7*a* has contact with the external face of the external heating belt 3 at a position in a free state on the external heating belt 3 suspended in a tensioned state between the two heat rollers 4*a* and 4*b* (i.e., at a position where the inner surface of the external heating belt 3 does not have contact with the heat roller 4*a* and 4*b*). In addition, the edge of the cleaning section 7*a* has contact with the external face of the external heating belt 3 so as to be directed in a counter direction to the rotation direction of the external heating belt 3, i.e., so as to form a contact angle θ (θ=150° in the present embodiment) of more than 90° which contact angle θ is an inclination angle between (i) an external face of the external heating belt 3 which external face lies at an upstream, in the rotation direction of the external heating belt 3, of an abutting section of the external heating belt 3 at which abutting section the external heating belt 3 has contact with the scraper 7 and (ii) a surface of the scraper 7 which surface (a) includes an abutting section of the scraper 7 at which abutting section the scraper 7 has contact with the external heating belt 3 and (b) faces the external face of the external heating belt 3.

Figure 5:
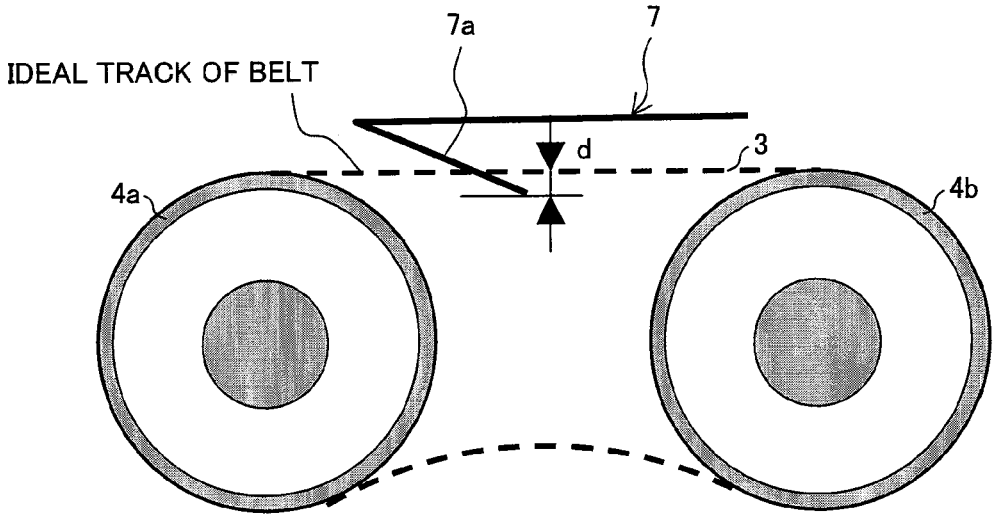
FIG. 5 is an enlarged view of a main part of an external heating unit provided in the fixing device illustrated in FIG. 1, which view illustrates an abutting section between an external heating belt and the scraper in the external heating unit.

FIG. 5 is an enlarged view of a main part of the external heating unit 13, which view illustrating the abutting section between the external heating belt 3 and the scraper 7 in the external heating unit 13. As illustrated in FIG. 5, a shape and an installation position of the scraper 7 are determined so that the edge of the cleaning section 7*a* of the scraper 7 pushes down the external heating belt 3 by a predetermined pushing depth d (d=0.6 mm in the present embodiment) with respect to an ideal track of the external heating belt 3 (i.e., with respect to a common tangent between the external heat rollers 4*a* and 4*b* which are positioned at an upstream and a downstream, respectively, in the rotation direction of the external heating belt 3, of the abutting section between the scraper 7 and the external heating belt 3).

In the present embodiment, as illustrated in FIG. 4, the scraper 7 for cleaning the outer surface of the external heating belt 3 is provided so as to have contact with the external face at a position where the inner surface of the external heating belt 3 does not have contact with the external heat rollers 4*a* and 4*b*.

This makes it possible to make a sliding load between the cleaning member and the external heating belt 3 lower than that caused in the conventional arrangement in which the cleaning member has contact with the external heating belt at a position where the external heating belt is suspended by the suspension roller. As a result, it is possible to suppress damage of the external heating belt 3 caused by rubbing between the cleaning member and the external heating belt 3, and suppress slipping of the external heating belt 3 caused by a load increased in a direction opposite to the rotation direction of the external heating belt 3.

The cleaning pad 12 is a member for collecting contaminants such as toner and paper powder which have partially passed through the scraper 7. That is, in a case where such contaminants adhered to the external heating belt 3 partially pass through the scraper 7, in some cases, the contaminants adhere to the outer surface of the external heating belt 3 as streaks along the rotation direction of the external heating belt 3, and the contaminants adhered to the outer surface makes contact with the outer surface of the fixing roller 1, thereby damaging the outer surface. The streaky contaminants adhered onto the outer surface of the external heating belt 3 cause streaky damage (image defect) in an image fixed on the sheet of recording paper 9. The streaky image defect is likely to be prominent particularly in the case of printing on a sheet of cardboard. As a solution to this, the present embodiment prevents the streaky image defect by provision of the cleaning pad 12 for collecting the contaminants such as toner and paper powder which have partially passed through the scraper 7.

Moreover, the cleaning pad 12 serves also as a release agent applying means for applying silicone oil (release agent) to the external face of the external heating belt 3.

As illustrated in FIG. 4, the cleaning pad 12 is made up of a felt holding member 12*b* and a felt member (cleaning member) 12*a* for cleaning attached thereto. In the present embodiment, felt made of fluororesin (PTFE: polytetrafluoroetylene) fibers is used as the felt member 12*a*. Further, the felt member 12*a* is impregnated with silicone oil. The felt holding member 12*b* is a plate-like member made of a 0.2 mm thick stainless steel plate. The felt holding member 12*b* is fixed to the external heating unit holder 11 so as to pressure the felt member 12*a* against the external face of the external heating belt 3.

The control section 16 includes the temperature control section 14 and a rotation control section 17. On the basis of temperature measurements of the thermistors 6*a* through 6*c*, a size of a sheet of recording paper, etc., the temperature control section 14 controls power supplied from the power supply circuit 15 to the heater lamps 5*a* through 5*d*, so that respective temperatures of the fixing roller 1 and the pressure roller 2 become close to predetermine ones, or the predetermined temperatures thereof are maintained. The rotation control section 17 controls operation of the rotary drive section 18 which performs rotary driving of the fixing roller 1. The control section 16 can be provided in the main control section of the image forming apparatus 100. Alternatively, the control section 16 can be provided separately from the main control section, and can operate in cooperation with the main control section.

Thus, the fixing device 30 (i) feeds the sheet of recording paper 9 on which the unfixed toner image is formed, between the fixing roller 1 and the pressure roller 2 which are heated to respective predetermined temperatures and which are pressed against each other at the predetermined load, and (ii) passes the sheet of recording paper 9 therebetween, thereby fixing the unfixed toner image on the sheet of recording paper 9.

1-3. Experimental Result

The following describes results of an experiment conducted to find relations between offset and application of a release agent to the external heating belt 3.

The experiment of the image forming apparatus 100 was carried out for a plurality of cases which were different from each other in that the cleaning pad 12 was provided or not, and a release agent was applied to the external heating belt 3 or not. In each of the cases, 100 sheets of invoice-sized (small-sized) paper (215.9 mm×139.7 mm) were longitudinally (a width of a direction perpendicular to a carrying direction was 139.7 mm) fed in succession for forming images. Right after that, 5 sheets of letter-sized (normal-sized) paper (279.4 mm×215.9 mm) were longitudinally (a width of the direction perpendicular to the carrying direction was 215.9 mm) fed in succession for forming images. Then, areas on the sheets of the letter-sized paper which correspond to a non-passage area of the fixing roller through which area the sheets of the invoice-sized paper had not been passed were visually confirmed as to whether or not an offset was generated.

A method for evaluating offset was as below. 100 invoice-size (8.5 inches×5.5 inches) small sheets of paper were sequentially printed by longitudinal feed. Immediately after that, 5 letter-size (11 inches×8.5 inches) regular-size sheets of paper were sequentially printed by longitudinal feed. Then, whether or not offset had occurred in areas on the letter-size regular-size sheets of paper was visually confirmed which areas correspond to a non-passage area through which the invoice-size small sheets of paper had not been passed. Specifically, an evaluation of a result of the visual examination was classified into any one of the following levels: a level at which no offset was observed at all (indicated by GOOD); a level at which minor offset occurred (indicated by FAIR); and a level at which remarkable offset occurred (indicated by POOR).

In a passage area on the surface of the fixing roller 1 through which passage area a small-size sheet of paper (in the present embodiment, an invoice-size sheet of recording paper) is passed through, a coating material etc. adhered onto the fixing roller 1 are cleaned by the invoice-size sheet of recording paper. Therefore, releasability of the fixing roller 1 is unlikely to decrease. Sequential fixing processes performed on the small-size sheets of paper cause the non-passage area to undergo a temperature rise (temperature rise from 30° C. to 35° C. as compared to an temperature of the passage area) at its edge. Accordingly, the non-passage area is more likely to cause hot offset than the passage area is. Furthermore, a sheet of paper which has been negatively charged (approximately −500V) in a transfer section passes through the passage area. Accordingly, the passage area has a negative electric potential which is higher than that of the non-passage area, and therefore has a large electrostatic repulsion against negatively-charged toner. As a result, the passage area is unlikely to electrostatically cause offset. For these reasons, offset is likely to occur in the non-passage area in a case where a regular-size sheet of paper (a letter-size sheet of paper) is passed through the non-passage area immediately after fixing processes are sequentially performed on small-size sheets of paper. In consideration of this, examined was a level of offset caused in the non-passage area through which a small-size sheet of paper was not passed.

Table 1 illustrates results of the experiment.

TABLE 1

| | Scraper | Cleaning Pad | Release Agent Applying Means | Offset |
|---|---|---|---|---|
| Comparative Example 1 | Stainless Steel | Fluorine Fiber | None | POOR |
| Comparative Example 2 | Stainless Steel | None | None | FAIR |
| Example 1 | Stainless Steel | Fluorine Fiber | Pad (impregnated with oil) | GOOD |
| Example 2 | Stainless Steel | None | Oil Applying Roller | GOOD |

Comparative Example 1 is a case where silicone oil (release agent) was not applied to the cleaning pad 12 of the external heating unit 13. In this case, an offset was noticeably generated.

Comparative Example 2 is a case where the cleaning pad 12 was omitted in the external heating unit 13. In this case, an offset was hardly generated. However, in this case, due to absence of the cleaning pad 12, streaky contaminants which had passed through the scraper 7 adhered onto the surface of the external heating belt 3. The streaky contaminants damaged the surface of the fixing roller 1. This resulted in a remarkable image flaw.

Example 1 is a case where the above described external heating unit 13 was used. Note that an application amount of the silicone oil was 0.05 mg per one sheet of letter-sized paper. In this case, silicone oil was applied to the external face of the external heating belt 3 by the cleaning pad 12, whereby a generation of an offset was prevented. The following (i) and (ii) can be considered as reasons for the result.

(i) Due to a lubricating effect of the silicone oil, the coating material (coating layer) of the external heating belt 3 was hardly scraped by the scraper 7.

(ii) The silicone oil applied to the external heating belt 3 was transferred to the surface of the fixing roller 1, whereby releasability of the surface of the fixing roller 1 became high. As a result, coating material scraped by the scraper 7 and a toner hardly adhered to the surface of the furser roller 1.

Figure 6:
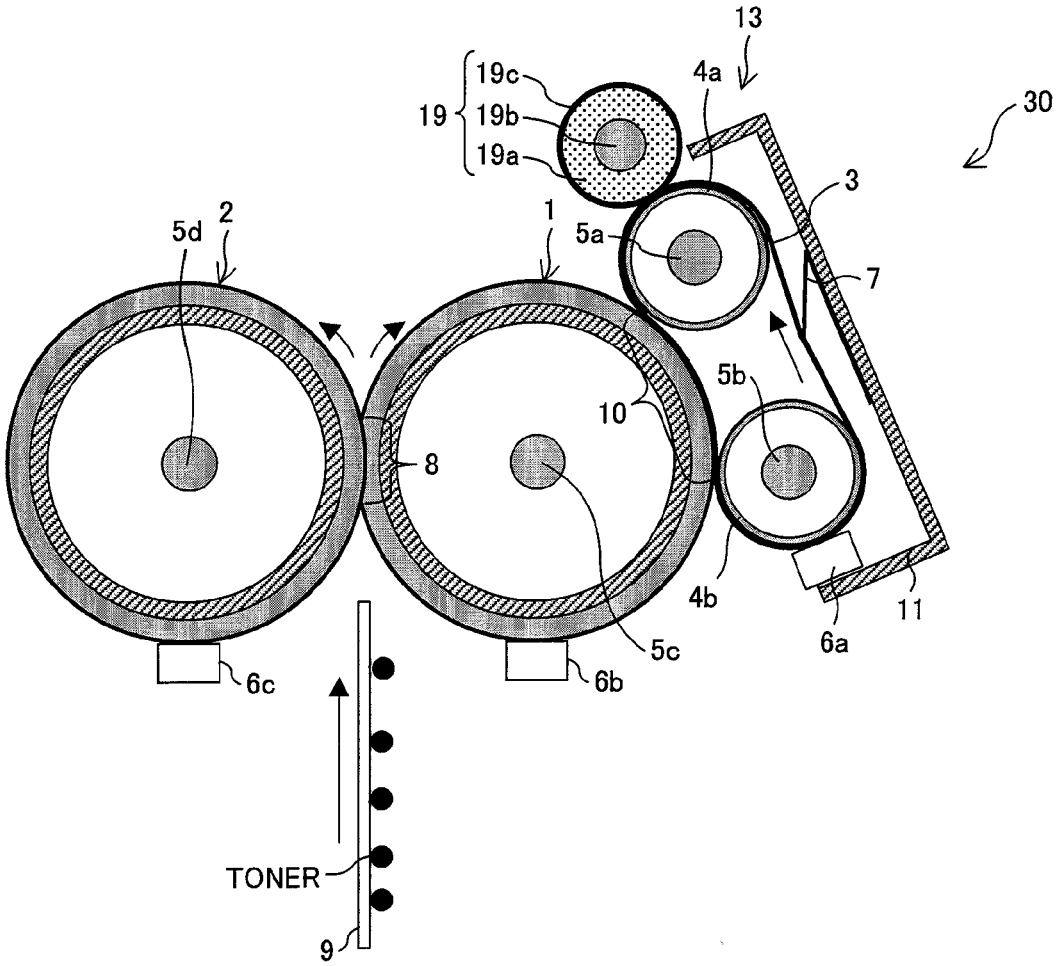
FIG. 6 is an explanatory view illustrating a configuration of a fixing device according to another embodiment of the present invention.

FIG. 6 is an explanatory view illustrating a configuration of a fixing device in Example 2. As shown in FIG. 6, Example 2 is a case where an oil applying roller (release agent applying means) 19 for applying silicone oil (release agent) to the external heating belt 3 was provided, instead of the cleaning pad 12 provided in the external heating unit 13 shown in FIG. 1.

The oil applying roller 19 is a roller member which has a diameter of 16 mm and a three-layer structure including: a cored bar 19*a*; an oil holding layer 19*b*; and an oil controlling layer 19*c*.

The cored bar 19*a* is a metal shaft made of stainless steel or the like. The oil holding layer 19*b*, in which Nomex felt or silicone rubber, etc. is impregnated with silicone oil, is formed on the cored bar 19*a*. A surface of the oil holding layer 19*b* is wrapped by a porous PTFE sheet as the oil controlling layer 19*c*. According to the configuration, the silicone oil held by the oil holding layer 19*b* exudes by a predetermined amount on the surface of the oil applying roller 19 via the oil controlling layer 19*c*. The exuded silicone oil is applied to the surface of the external heating belt 3.

As shown in Table 1, an offset was not generated in the case of Example 2, as with the case of Example 1.

Note that, in the configuration of Example 1, the cleaning pad 12 serves as both a cleaning member and a release agent applying means. Accordingly, another release agent applying means does not need to be provided other than the cleaning member. This leads to a simplification of the configuration of the fixing device 30. On the other hand, the configuration of Example 2 includes the oil holding layer 19*b* and the oil controlling layer 19*c*. With the configuration, the silicone oil is applied stably to the external heating belt 3 throughout the life of the fixing device 30. This allows the fixing device 30 to have a longer product life.

As described above, in the present Embodiment, the silicone oil is applied to the surface (external face) of the external heating belt 3. This prevents the surface of the external heating belt 3 from being scraped by the scraper 7 having contact therewith. Accordingly, it is possible to prevent adhesion of coating material, etc., which has been scraped from the surface of the external heating belt 3, to the surface of the fixing roller 1. This prevents generation of an offset.

Note that, in the present embodiment, the silicone oil is used as a release agent to be applied to the external heating belt 3. However, the release agent is not limited to the silicone oil, but another release agent may be used.

In the present embodiment, the release agent is applied to the surface of the external heating belt 3. However, for example, the release agent may be applied to the surface (a face having contact with the external heating belt 3) of the fixing roller 1. In this case also, the release agent applied to the surface of the fixing roller 1 is transferred to the external heating belt 3, whereby a substantially same effect can be attained.

The present embodiment describes an arrangement such that the scraper 7 and the cleaning pad 12 are provided as the cleaning members. However, the present embodiment is not limited to this. For example, either the scraper 7 or the cleaning pad 12 can be omitted. Alternatively, another cleaning member such as a cleaning web can be provided instead of the scraper 7 or the cleaning pad 12.

In the present embodiment, the external heating unit 13 includes the external heating belt 3 as an external heating member which is to contact with the fixing member so as to heat up the fixing member. However, the present invention is not limited to this. For example, a roller member may be provided as the external heating member.

In the present embodiment, (i) the cleaning pad 12 serves also as the release agent applying means, or (ii) the oil applying roller 19 serves as the release agent applying means instead of the cleaning pad 12. However, the present invention is not limited to this. For example, another release agent applying means may be provided in addition to the cleaning pad 12. In this case, the release agent applying means may be, for example, a felt member impregnated with a release agent, or may be the oil applying roller 19.

As described above, the fixing device of the present invention includes: a fixing member which is capable of rotating; a pressure member which pressures the fixing member; an external heating member which abuts on a surface of the fixing member so as to heat up the fixing member, the external heating member being rotatably suspended; a cleaning member which is to contact with the surface of the external heating member so as to remove a contaminant adhered to the surface of the external heating member; and a release agent applying means which applies a release agent for improving releasability to (i) the surface of the external heating member which surface is to contact with the cleaning member and the fixing member or (ii) the surface of the fixing member which surface is to contact with the external heating member, a recording material being carried to a section between the fixing member and the pressure member and then a toner image on the recording material being thermally fixed to the recording member by heat conducted from the fixing member.

According to the configuration, by the release agent applying means, a release agent for improving releasability is applied to (i) the surface of the external heating member which surface is to contact with the cleaning member and the fixing member or (ii) the surface of the fixing member which surface is to contact with the external heating member. The release agent serves to prevent a surface material of the external heating member from being scraped by the cleaning member. Moreover, (i) the release agent, which has been applied on the surface of the external heating member and then transferred to the surface of the fixing member, or (ii) the release agent applied to the surface of the fixing member improves releasability of the surface of the fixing member. Accordingly, a substance, etc. scraped from the external heating member by the cleaning member and a toner hardly adhere to the surface of the fixing member. This makes it possible to prevent an offset from being generated.

Note that the external heating member may be an endless belt suspended by a plurality of suspending rollers.

Moreover, the release agent applying means may include (i) a release agent holding layer made of a material impregnated with a release agent and (ii) a release agent controlling layer made of a porous material, the release agent being exuded from the release agent holding layer and applied via the release agent controlling layer.

According to the configuration, an application amount of the release agent to be applied can be stabilized throughout a product life of the fixing device by the release agent controlling layer made of a porous material. This makes it possible to stably attain the effect of preventing an offset for long periods.

Moreover, the release agent applying means may apply the release agent to the surface of the external heating member by causing a felt member impregnated with the release agent to have contact with the surface of the external heating member.

According to the configuration, the felt member is to contact with the external heating member, whereby the felt member also serves as a cleaning member. Accordingly, a cleaning effect on the external heating member can be improved.

Moreover, the cleaning member can be a scraper which is a plate-like member whose edge is to contact with the surface of the external heating member so as to remove the contaminant adhered onto the surface of the external heating member. Moreover, the scraper can be made of metal.

According to the arrangement, the use of a scraper having a high cleaning capability makes it possible to efficiently remove the contaminant on the external heating member. This makes it possible to suppress deterioration in image quality caused in such a manner that the contaminant on the external heating member adheres to the fixing member, and further adheres therefrom to the recording material.

The cleaning member can be a cleaning pad whose surface is to contact with the surface of the external heating member so as to remove the contaminant adhered onto the surface. The cleaning pad can be a felt member made of fluororesin fibers.

According to the arrangement, the use of the cleaning pad makes it possible to efficiently remove the contaminant on the external heating member. This makes it possible to suppress deterioration in image quality caused in such a manner that the contaminant on the external heating member adheres to the fixing member, and further adheres therefrom to the recording material. This also makes it possible to reduce an amount of a substance scraped from the external heating member by the cleaning member, and thereby suppress the occurrence of offset due to adhesion of the substance to the surface of the fixing member.

The fixing device can include the scraper and the cleaning pad as the cleaning member.

This makes it possible to suppress deterioration in image quality caused in such a manner that the contaminant on the external heating member adheres to the fixing member, and further adheres therefrom to the recording material. In addition, the arrangement allows the cleaning pad to remove the substance scraped by the scraper from the external heating member. This makes it possible to suppress more properly offset caused by the adhesion of the substance onto the surface of the fixing member.

An image forming apparatus of the present invention includes any one of the fixing devices.

According to the configuration, due to an effect of the release agent, a surface layer material of the external heating member is hardly scraped by the cleaning member. Moreover, the release agent applied to the external heating member is transferred to the surface of the fixing member, whereby releasability of the surface of the fixing member becomes high. Accordingly, a material, etc. scraped from the external heating member by the cleaning member and a toner hardly adhere to the surface of the fixing member. This can prevent generation of an offset.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to a fixing device to be provided in an image forming apparatus of an electrophotographic printing method.

What is claimed:

1. A fixing device comprising:

a fixing member which is capable of rotating;

a pressure member which pressures the fixing member;

an external heating unit having an external heating member which is in contact with a surface of the fixing member so as to heat up the fixing member, the external heating member being rotatably suspended;

a cleaning member which is in contact with a surface of the external heating member so as to remove a contaminant adhered to the surface of the external heating member; and a release agent applying means which applies a release agent for improving releasability to the surface of the external heating member which surface is in contact with the cleaning member and the fixing member, a recording material being carried to a section between the fixing member and the pressure member and then a toner image on the recording material being thermally fixed to the recording member by a heat conducted from the fixing member, the external heating member being an endless belt suspended by a plurality of suspending rollers, the cleaning member being a scraper which is a plate-like member whose edge is in contact with the surface of the external heating member so as to remove the contaminant adhered onto the surface of the external heating member, the release agent applying means (i) applying the release agent to the surface of the external heating member and (ii) removing the contaminant on the surface of the external heating member, by causing a felt member impregnated with the release agent to have contact with the surface of the external heating member, the scraper being in contact with an outer surface of the endless belt at a position where an inner surface of the endless belt is not in contact with the plurality of suspending rollers, and the release agent applying means being in contact with the outer surface of the endless belt at (i) a position situated (a) at a downstream, in a rotation direction of the external heating member, of a section at which the scraper is in contact with the external heating member and (b) at an upstream, in the rotation direction, of a section at which the fixing member is in contact with the external heating member and (ii) a position where the inner surface of the endless belt is in contact with any of the plurality of suspending rollers.

2. The fixing device as set forth in claim 1, wherein the scraper is made of metal.

3. The fixing device as set forth in claim 2, wherein:

the scraper is made up of (i) a cleaning section having the edge, (ii) a holding section, and (iii) a folded section, the folded section being formed by folding the plate-like member along a straight line and at a sharp angle so as to be located between the cleaning section and the holding section, and the holding section being attached to a housing of the external heating unit; and a plurality of slits are provided in the scraper by cutting into the folded section in a direction perpendicular to the straight line, each of the plurality of slits being formed so as to extend from the folded section to the cleaning section and to the holding section.

4. An image forming apparatus comprising a fixing device recited in claim 1.

* * * * *